United States Patent [19]

Keller et al.

[11] 4,394,790

[45] Jul. 26, 1983

[54] FIBER FEEDING APPARATUS WITH CONTROLLED AIR FLOW

[75] Inventors: Alex J. Keller, Clover, S.C.; Akiva Pinto, Gastonia, N.C.

[73] Assignee: Automatic Material Handling, Inc., Bessemer City, N.C.

[21] Appl. No.: 336,016

[22] Filed: Dec. 30, 1981

[51] Int. Cl.[3] ..... D01E 15/40

[52] U.S. Cl. ..... 19/105; 222/52; 406/70; 406/171

[58] Field of Search ..... 19/105, 97.5, 239, 240, 19/300, 304; 406/70, 171, 173, 175; 55/454, 457 B; 222/52

[56] References Cited

U.S. PATENT DOCUMENTS

| | | | |
|---|---|---|---|
| 3,482,883 | 12/1969 | Hecker | 406/175 |
| 3,728,759 | 4/1973 | Hergeth | 19/105 |
| 3,896,523 | 7/1975 | Beukert | 19/105 |
| 4,009,803 | 3/1977 | Lytton et al. | 19/105 X |
| 4,136,911 | 1/1979 | Husges et al. | 19/105 X |
| 4,161,052 | 7/1979 | Erben | 19/240 |
| 4,176,988 | 12/1979 | Lattmann | 19/105 X |
| 4,219,289 | 8/1980 | Trützschler | 19/105 X |
| 4,240,180 | 12/1980 | Wood | 19/105 |
| 4,280,251 | 7/1981 | Ludwig | 19/105 |
| 4,321,732 | 3/1982 | Erben | 19/105 |

FOREIGN PATENT DOCUMENTS

| | | | |
|---|---|---|---|
| 2835114 | 3/1979 | Fed. Rep. of Germany | 19/105 |
| 1184747 | 3/1970 | United Kingdom . | |

*Primary Examiner*—Louis K. Rimrodt
*Attorney, Agent, or Firm*—Richards, Shefte & Pinckney

[57] ABSTRACT

A chute feed having a chute formed in part by an upper perforated wall portion and a lower oscillating wall portion. Two compartments are formed adjacent the chute and are separated therefrom by the upper and lower wall portions, and a divider wall is disposed to extend from the front of the chute feed to a location between the upper and lower edges of the upper perforated wall portion, such divider wall separating the two compartments and permitting the compartments to be exposed to upper and lower parts of the perforated wall portion, respectively. A blower having an inlet connected to a location outside the chute feed directs a path of air around the opening roller of the chute feed, through the perforated wall portion, and into the upper compartment where the air, and any dust or micro-dust entrained therein is sucked from the upper compartment by an air outlet conduit adapted to be connected to the vacuum of the extractor associated with the card being fed by the chute feed, whereby the air flow serves to level the fiber in the chute and also to remove and exhaust dust and micro-dust from the fiber. The lower compartment causes air to be forced into the chute through the lower part of the perforated wall portion during movement of the oscillating wall portion in its non-densifying direction, such air acting to assist in compacting the fiber in the chute.

10 Claims, 3 Drawing Figures

10
84
58
64
62
38
40
70
66
68
78
72
34
34
80
74

FIBER FEEDING APPARATUS WITH CONTROLLED AIR FLOW

BACKGROUND OF THE INVENTION

In U.S. patent application Ser. No. 207,394, filed Nov. 17, 1980, now abandoned, there is disclosed a fiber feeding apparatus, commonly called a chute feed, for collecting and densifying fiber to be fed as a batt to a carding machine and the like. As described in greater detail in such application, the vertically extending wall forming the chute of the apparatus is perforated at its upper end, and a blower is utilized to create an air circulation path that flows from the discharge of the blower, around the upper end of the opening roller in the chute feed and generally tangentially therefrom, and then through the perforated wall portion and back to the inlet of the blower in a closed circuit. This arrangement offers the advantages of imposing a leveling influence on the fiber collecting in the vertical chute, and of keeping the lint and fiber dust within the chute feed by virtue of the closed air circulation path so as to avoid the necessity of having to filter the air, all as set forth in the foregoing application.

While the above-described chute feed offers significant advantages in some textile processing systems, there are other systems where it is important to remove the fiber lint, dust, or micro-dust altogether from the fiber batt formed by the chute feed. For example, in open end spinning applications, it is particularly advantageous to have the batt made essentially free of lint, dust and particularly micro-dust.

It is, of course, well known in the art to provide chute feeds which use an induced air flow to transport entrained fiber tufts to the vertical chute and to compress the fiber collected therein, typical examples of such chute feeds being disclosed in U.S. Pat. Nos. 3,482,883 and 4,219,289. It is also known to provide air delivery systems for fiber tufts which include some arrangement for exhausting the air through any convenient vacuum source, such as the existing extractor found on carding machines which are fed by the chute feeds. Thus, in U.S. Pat. No. 4,136,911, air from a blower is forced down through the vertical column of collected fiber in the chute feed and removed through an apertured wall near the bottom of the column which is connected to the card extractor. In U.S. Pat. No. 4,176,988, air with fiber entrained therein is removed through a perforated wall of the vertical chute and exhausted by any suitable vacuum source.

Where air is used to deliver fiber to the chute feed and/or compress fiber in the chute feed by being forced downwardly through a substantially vertical column of fiber, variations in the pressure or flow of such air do not appear to be particularly significant since the delivery of, or compression of, the fiber will not be substantially affected by such variations. Thus, where the air is exhausted by using the vacuum source available from the card extractor, it is known that the vacuum offered by the card extractor will vary, depending on the load that is imposed on the extractor at any given time, but this variation does not appear to adversely affect the fiber delivery and/or fiber compressing function of the air system. However, where the air system is utilized in a manner described in the aforesaid U.S. application Ser. No. 207,394 to causing leveling of the fiber by passing the air through perforations located adjacent the upper end of the vertical chute, it has been found that variations in the vacuum source used to exhaust the air will have an adverse effect on the ability of the air flow to level the fiber at the upper end of the vertical chute. Therefore, in accordance with the present invention, a chute feed is provided with a unique air flow arrangement which serves to separate the fiber from the opening roller, cause leveling of the fiber in the vertical chute, and then exhaust the air and any dust or micro-dust therein in a controlled pressure environment that does not adversely effect the fiber leveling function of the air flow.

Additionally, some chute feeds include an oscillating plate that forms one wall of the vertical chute, and this plate moves toward and away from an opposed fixed wall forming another wall of the vertical chute to thereby mechanically compress or densify the fiber in the vertical chute during movement of the oscillating plate in its compressind direction, typical examples of chute feeds having oscillating compression plates being disclosed in U.S. Pat. Nos. 3,896,523 and 3,728,759. While these oscillating plates have the obvious effect of compressing the fiber when the plate moves in a direction toward the fixed plate, the movement of the plate in the opposite direction has a tendency to permit the fiber between the plates to reexpand or open, thereby reducing, to at least some extent, the effectiveness of the mechanical compression of the fiber by the oscillating plate. Moreover, when the oscillating plate is used in combination with a fiber leveling system as disclosed in the aforesaid application Ser. No. 207,394, the movement of the oscillating plate in opposite directions will result in somewhat different pressure conditions in the compartment which is receiving air through the perforated plate, and this pressure difference can, at least to some extent, adversely effect the aforesaid controlled pressure environment that is desirable for maximum fiber leveling in the vertical chute. These drawbacks are overcome in the present invention, which not only isolates the oscillating plate from the air current used to cause leveling of the fiber so as to remove any tendency for the plate to affect the leveling air circulating system, but which also utilizes the movement of the plate in both directions to assist in compressing the fiber in the vertical chute.

SUMMARY OF THE INVENTION

In accordance with the present invention, a chute feed is provided which includes an axially extending roller and a substantially enclosed fiber collecting chute which extends generally downwardly beneath the opening roller to receive fibers therefrom. The chute includes a generally vertically extending wall having an upper portion formed with perforations and a lower portion arranged for oscillating movement toward and away from a fixed wall of the chute for densifying the fiber in the chute during movement of the oscillating wall portion. An air circulating arrangement is provided which includes a blower and which directs a flow of air in a path around the opening roller to assist in separating fiber tufts therefrom, and then through the perforated upper wall portion to assist in leveling the fiber collected in the chute, all in the same general manner as that described in the aforesaid U.S. application Ser. No. 207,394.

However, as contrasted with the chute feed described in the aforesaid application, the chute feed of the present invention provides a first closed compartment which includes an air outlet means that is adapted to be connected to the existing extractor system of the carding machine which is being fed to the chute feed, this first closed compartment being adjacent to the vertical chute and being separated therefrom by at least a portion of the perforated upper wall portion so that air passing therethrough flows into the first closed compartment and is drawn from the first closed compartment and from the chute feed by the vacuum imposed on the first closed compartment by the card extractor. It is to be noted that the air which flows around the opening roller and toward the perforated upper wall portion is passing around and through the fiber tufts at a point where lint, dust and micro-dust associated with the fiber tufts are most susceptible to being adequately separated from the tufts and carried away by the air flow to the card extractor.

This use of the available card extractor vacuum to remove micro-dust, as aforesaid, provides significant advantages in providing a fiber batt which has a significantly reduced micro-dust content, but it was found that the imposition of the card extractor vacuum behind the perforated upper wall portion had an adverse effect on the aforesaid fiber leveling function of the air flow. It is believed that this adverse affect results from the fact that the degree of vacuum drawn by the card extractor is constantly varying, and this variable vacuum, unless corrected, tends to create an uncontrolled or uneven pressure environment for the air flow through the perforated plate which, in turn, creates an uneven leveling effect on the fiber in the chute.

In accordance with the present invention, the aforesaid adverse affect resulting from the card extractor vacuum is corrected by modifying the first closed compartment to reestablish an even or controlled air flow through the perforated plate, notwithstanding the presence therein of the card extractor vacuum. More specifically, the inlet to the blower, which heretofore drew air from the compartment, is connected to an inlet which extends to the blower from outside the first closed compartment so that the blower does not impose any vacuum within such compartment. Additionally, the first closed compartment is provided with an air inlet, preferably in the form of a flap valve, that selectively admits outside air into the compartment when there is a predetermined negative pressure therein. The combination of drawing air into the blower from outside the compartment while providing a selectively operable air inlet valve to the compartment has an equalizing effect on the pressure variation created by the card extractor vacuum, and results in a controlled air flow through the perforated plate that promotes effective leveling of the fiber collected at the top of the chute.

In accordance with a further feature of the present invention, a second closed compartment is provided adjacent the chute and is separated therefrom by at least a portion of the perforated upper wall portion and by the oscillating lower wall portion. By virtue of this arrangement, the oscillating plate will, in its conventional operation, compress or densify the fiber in the chute during its aforesaid movement toward the fixed chute wall, and, additionally, the movement of the oscillating plate in the other direction will tend to develop a pressure increase in the second closed compartment that forces air to flow from such compartment, through the perforated upper wall portion, and into the chute to assist in compressing the fiber in the chute even when the oscillating wall portion is moving away from the first wall of the chute.

DESCRIPTION OF THE PREFERRED EMBODIMENT

Figure 1:
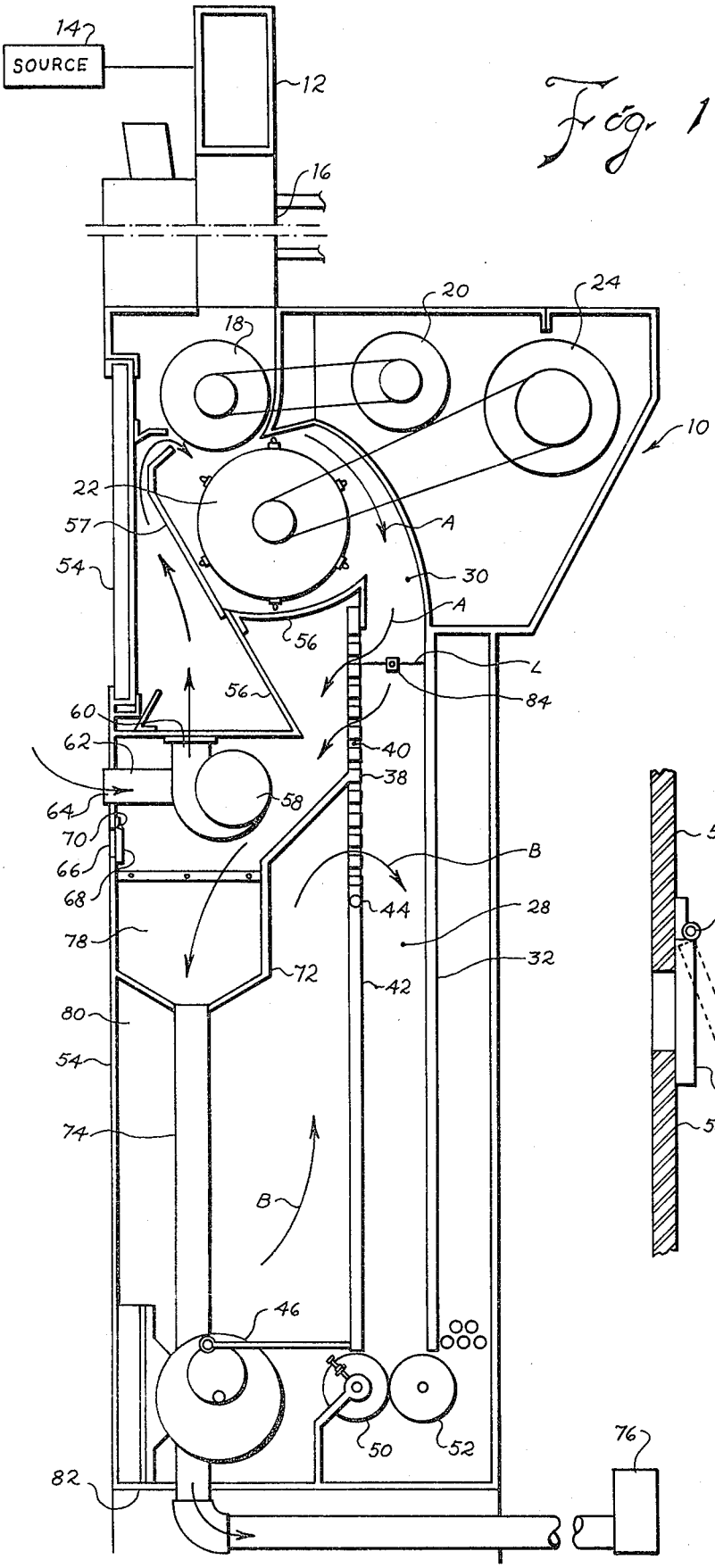
FIG. 1 is a diagrammatic side elevational view of the fiber feeding apparatus of the present invention.

FIG. 1 illustrates a fiber feeding apparatus or chute feed 10 disposed beneath an inlet duct 12 through which fiber tufts from any suitable source 14 are delivered conventionally in an air stream that is exhausted through a perforated plate or opening 16 with the fiber tufts collecting in the inlet duct 12. The chute feed 10 includes a feed roller 18 driven by a motor 20 to deliver fiber from the inlet duct 12 to an axially extending opening roller 22 rotationally mounted in chute feed 10 and driven by a motor 24, the opening roller 22 having a plurality of projections 26 extending radially therefrom to open the fiber tufts delivered by the opening roller 22.

A substantially enclosed chute 28 extends generally downwardly beneath the opening roller 22 and has an open end 30 extending along and parallel to the axis of the opening roller 22 to receive fiber tufts as they leave the surface thereof. The chute 28 includes a fixed, imperforate wall 32, two side walls 34 (see FIG. 2), and a generally vertically extending wall 36 having a width that is substantially equal to the axial extent of the opening roller 22. This wall 36 includes an upper wall portion 38 formed with a large plurality of perforations 40 formed in an area extending across the width thereof and extending below, and in some cases above, the normal level of fiber collected in the chute 28, this level being indicated by the reference letter L. The wall 36 also includes a lower wall portion 42 that is pivoted at its upper end 44 for oscillating movement toward and away from the fixed wall 32, such oscillating movement being obtained by a drive motor 46 and an eccentric linkage 48 connected at the bottom end of the wall portion 42. A pair of conventional feed rollers 50 and 52 are disposed at the bottom of the chute 28 to deliver fiber therefrom in batt form to a conventional carding machine (not shown).

Figure 3:
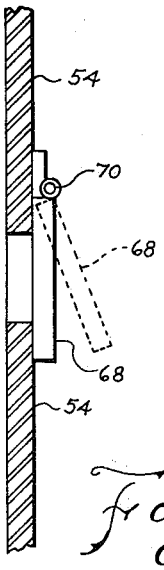
FIG. 3 is a detail diagrammatic view of the inlet opening and valve associated with one of the closed compartments of the apparatus illustrated in FIG. 1.

The chute feed 10 includes a front wall 54, usually formed at least in part of a clear plastic material to permit viewing of the inside of the chute feed 10, and a first divider wall 56 extends between the top of the chute wall 36 and the front wall 54 to divide the upper portion of the chute feed 10 surrounding the opening roller 22 from the portion of the chute feed 10 adjacent the wall 36. A blower 58 driven by an electric motor is mounted on the divider wall 56, and the blower 58 has an outlet conduit 60 extending up through the divider wall 56 so that air is discharged upwardly and guided to and around the upper portion of the opening roller 22 by a guide wall 57. The blower 58 is also connected to an inlet conduit 62, preferably in the form of flexible tubing, which extends from the inlet of the blower 58 to an inlet opening 64 formed in the front wall 54 of the chute feed 10, such inlet conduit 62 permitting the blower 58 to draw in ambient air from outside the chute feed 10. The front wall 54 also includes a second air inlet opening 66 extending therethrough, and, as best seen in FIG. 3, a flap valve 68 is mounted to the inside surface of the front wall 54 by a hinge 70, the flap valve normally covering the second air inlet opening 66 to prevent air from flowing outwardly therethrough and being selectively operable to pivot inwardly as shown in dotted lines in FIG. 3 to permit air to flow inwardly through the opening 66 as will be explained in greater detail presently. The flap valve 68 is preferably maintained in its closed position by gravity, but a spring or other biasing means (not shown) may be added, if desired, to maintain the flap valve 68 at its closed position until there is a predetermined negative pressure inside of the front wall 54.

Figure 2:
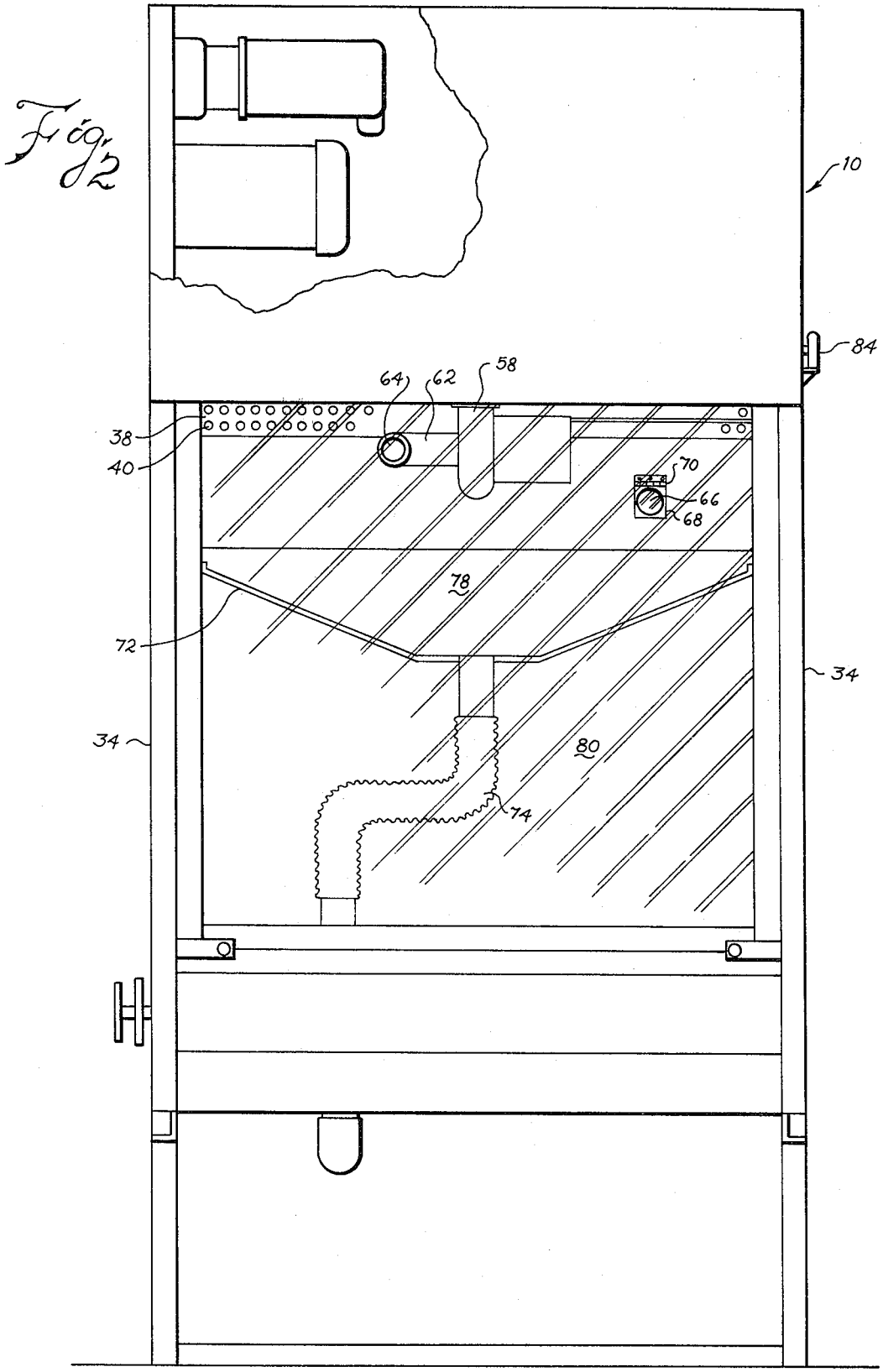
FIG. 2 is a diagrammatic front view of the apparatus illustrated in FIG. 1.

A second divider wall 72 extends, as shown in FIGS. 1 and 2, from the front wall 54 of the chute feed 10 to the upper perforated upper wall portion 38 and engages the latter at a suitable location between the upper and lower ends thereof. The lower part of the second divider wall 72 has a generally V-shaped configuration as best seen in FIG. 2, and an air outlet conduit 74, preferably in the form of flexible tubing, extends from the lowest part of the second divider wall 72 to a location outside of the chute feed 10, and is adapted to be connected directly to the conventional card extractor system 76 (illustrated in block form in FIG. 1) of the aforesaid carding machine being supplied with a fiber batt by the chute feed 10.

Looking at FIG. 1, it will be noted that the interior of the chute feed 10 to the left of wall 36 is divided into two essentially closed compartments, the upper compartment 78 being formed between the two divider walls 56,72, the top part of the perforated upper wall portion 38 and front wall 54, and the two side walls 34, and the bottom compartment 80 being formed between the lower divider wall 72 and the bottom wall 82 of the chute feed, the front wall 54 and the lower part of perforated wall portion 38 and the oscillating wall portion 42, and the side walls 34.

The chute feed 10 also includes an electric eye 84 housed in one of the side walls 34 for controlling the level L of the fiber in the chute 28 in a conventional manner. The electric eye 84 is preferably placed at a vertical height near the top of the perforated wall portion 38, and is usually arranged on an adjustable mounting device (not shown) which permits its position to be selectively adjusted as desired. When the fiber level L drops beneath a predetermined level, this drop will be sensed by the electric eye 84 which generates a signal that operates the motor 24 to selectively drive the feed roller 18 whereby more fiber is fed thereby to the chute 28.

The operation of the above-described chute feed 10 is as follows. Fiber tufts are delivered to the inlet duct 12 and accumulate therein. When the electric eye 84 senses that the fiber level L in the chute 28 has dropped below a predetermined level, the motor 24 is operated to rotate the feed roller 18 which feeds fiber tufts from the bottom of the inlet duct 12 to the opening roller 22 which opens the fiber tufts and causes them to fall by gravity into the chute 28 through the open upper end 30 thereof. The blower 58 generates a relatively gentle flow of air indicated by arrows A in FIG. 1 which moves from the outlet conduit 60 of the blower 58, around the periphery of the opening roller 22 in the direction of rotation thereof, then generally tangentially from the opening roller 22 toward the perforated wall portion 38, this air flow entraining the fiber tufts delivered from the opening roller 22 to assist in carrying them to the chute 28. Because the upper end of the perforated wall portion 38 forms one wall of the essentially closed upper compartment 78, and because the vacuum of the card extractor 76 is constantly imposed on the interior of the upper compartment 78 through the conduit 74, the air indicated by the arrows A is caused to flow through the upper part of the perforated wall portion 38 (that part above the divider wall 72) and into the upper compartment 78, leaving the fiber tufts in the chute 28, and then the air is exhausted from the upper compartment 78 through the exhaust conduit 74. The flow of air through the upper part of the perforated wall portion 38 tends to create a leveling effect on the top surface of the fiber within the chute 28 in the same manner as that described in greater detail in the aforesaid U.S. patent application Ser. No. 207,394. Moreover, it will be apparent that this air flow is passing through and around the fiber tufts as they are separated from the opening roller 22, and since these fiber tufts are, at this time, in a very open and loose condition, any dust or micro-dust associated with the fiber tufts are particularly susceptible to being separated therefrom by the air flow. The same situation is true to only a slightly lesser extent as to the fiber tufts which are collected at the top of the chute 28, adjacent the upper part of perforated wall portion 38, so that air passing down through these fibers and through the perforated wall portion 38 will remove dust and micro-dust from these fiber tufts. Accordingly, the air flow passing around the opening roller 22 and through the upper part of the perforated wall portion 38 will entrain a substantial amount of the dust and micro-dust associated with the fiber tufts, and this dust and micro-dust is carried into the upper compartment where it is ultimately removed to the card extractor 76 through the air outlet conduit 74, it being noted that the V-shaped configuration of the second divider wall 72 assists in directing the dust and micro-dust to the air outlet conduit 74.

Thus, the air flow generated by the blower 58 serves to level the fiber at the top of chute 28 and also to separate and carry off dust and micro-dust. The fiber leveling function of this air flow requires relatively even or controlled pressure conditions to reach maximum leveling efficiency, and the arrangement provided by the present invention provides such a controlled pressure environment. As is well known, the vacuum created by the card extractor 76 is variable because the degree of vacuum at any given time depends on the number and nature of other equipment which is periodically connected to and disconnected from the card extractor system as a whole, and the presence of such variations in the upper compartment 78 behind the upper part of perforated wall portion 38 would tend to adversely affect the fiber leveling function of the air flow unless such variations are dealt with. In the present invention, the air inlet opening 66 and associated flap valve 68 even out the aforesaid variation created by the card extractor 76 to the extent that when a high vacuum is created by the card extractor 76 the flap valve 68 will open, as shown in dotted lines in FIG. 3, to permit ambient air to flow into the upper compartment 78, thereby reducing the vacuum within the upper compartment 78 sufficiently to provide a generally even and controlled flow of air through the upper part of the perforated wall portion 38. Thus, the flap valve 68 permits air to flow into the compartment 66 when the pressure therein is below a predetermined level, and prevents the flow of air from the compartment 66 when the pressure therein is above a predetermined level. Moreover, it will be noted that the inlet conduit 62 of the blower 58 extends outwardly of the upper compartment 78 so that the vacuum created by the blower 58 is not added to the vacuum of the card extractor 76 in the upper compartment 78 so as to create an undesirable high vacuum condition therein.

In accordance with a further feature of the present invention, the bottom closed compartment 80 serves to assist in compacting or densifying the fiber in the chute 28 even during movement of the oscillating wall portion 42 in a direction away from the fixed wall 32. As described above, the oscillating wall portion 42 alternately moves in a first direction toward the fixed wall 32 to mechanically compress the fiber therebetween, and in a second direction away from the fixed wall 32 on its return stroke. Because the lower compartment 80 is essentially closed and is formed, in part, by the oscillating wall portion 42, it will be apparent that movement of the oscillating wall portion 42 in the direction away from the fixed wall 32 will contract or reduce the volume of the lower compartment 80 so that the air contained in such compartment will be pumped out of the compartment 80 through the openings 40 in the lower part of perforated wall portion 38 as shown by the arrows B in FIG. 1. This pumped air will flow into the chute 28, which has an expanding volume because of the movement of oscillating wall portion 42 away from the fixed wall 32, and will tend to flow downwardly into the expanding volume of the chute 28 to assist in densifying the fibers collected therein, thereby improving the characteristics of the batt formed by the chute feed 10 of the present invention.

The present invention has been described in detail above for purposes of illustration only and is not intended to be limited by this description or otherwise to exclude any variation or equivalent arrangement that would be apparent from, or reasonably suggested by the foregoing disclosure to the skill of the art.

We claim:

1. Apparatus for feeding fibers to textile processing equipment such as a carding machine, said apparatus including:

(a) an axially extending opening roller;

(b) a substantially enclosed fiber collecting chute means extending generally downwardly beneath said opening roller to receive fibers therefrom, said chute means including a generally vertically extending wall having an upper portion formed with perforations and having a lower portion arranged for oscillating movement for densifying the fiber in said chute means during movement in one direction;

(c) a first closed compartment adjacent said chute means and separated therefrom by at least a part of said upper wall portion, said closed compartment having air outlet means adapted to be connected to the extractor of said carding machine and having air inlet means for selectively admitting outside ambient air into said first closed compartment;

(d) air circulating means, including blower means, for generating a flow of air in a path around said opening roller, into said chute means, and through said perforated upper wall portion into said first closed compartment, said blower means having inlet means extending thereto from outside said first closed compartment whereby said blower does not create a vacuum in said first closed compartment; and (e) a second closed compartment adjacent said chute means and separated therefrom by a portion of said perforated upper wall portion and by said oscillating wall portion, whereby movement of said oscillating wall portion in the other direction thereof will cause air to be forced into said chute means through said perforated wall portion.

2. Apparatus for feeding fibers as defined in claim 1, and further characterized in that said air inlet means for said first closed compartment includes valve means for permitting air to flow into said first closed compartment from the outside when the pressure therein is below a predetermined level and for preventing the flow of air from said first closed compartment to the outside when the pressure therein is above a predetermined level.

3. Apparatus for feeding fibers as defined in claim 1, and further characterized in that said first closed compartment includes a generally V-shaped bottom wall portion for directing any dust or foreign matter towards the lowest point of bottom wall portion, and in that said air outlet means of said first closed compartment is disposed at said lowest point of said bottom wall.

4. Apparatus for feeding fibers as defined in claim 1, and further characterized in that said air inlet means of said closed compartment extends outside said apparatus whereby said blower draws in outside ambient air.

5. Apparatus for feeding fibers as defined in claim 1, and further characterized in that said first closed compartment is disposed above said second closed compartment and is separated therefrom by a divided wall extending from a front wall of said apparatus to said perforated wall portion at a location between the upper and lower ends thereof.

6. Apparatus for feeding fibers to textile processing equipment such as a carding machine, said apparatus comprising:

(a) an axially extending opening roller;

(b) a substantially enclosed fiber collecting chute means extending generally downwardly beneath said opening roller to receive fibers therefrom, said chute means including a generally vertically extending wall having an upper portion formed with perforations therein;

(c) a closed compartment adjacent said chute means and separated therefrom by at least a part of said upper wall portion, said closed compartment having air outlet means adapted to be connected to the extraction of said carding machine and having an air inlet means for selectively admitting outside air into said closed compartment; and (d) air circulating means, including blower means, for generating a flow of air in a path around said opening roller into said chute means and through said perforated upper wall into said closed compartment, said blower means having air inlet means extending thereto from outside said closed compartment whereby said blower does not create a vacuum in said closed compartment.

7. Apparatus for feeding fibers as defined in claim 6, and further characterized in that said air inlet means for said closed compartment includes valve means for permitting air to flow into said first closed compartment from the outside when the pressure therein is below a predetermined level and for preventing the flow of air from said first closed compartment to the outside when the pressure therein is above a predetermined level.

8. Apparatus for feeding fibers as defined in claim 6, and further characterized in that said closed compartment includes a generally V-shaped bottom wall portion for directing any dust or foreign matter towards the lowest point of bottom wall portion, and in that said air outlet means of said closed compartment is disposed at said lowest point of said bottom wall.

9. Apparatus for feeding fibers as defined in claim 6, and further characterized in that said air inlet means of said closed compartment extends outside said apparatus whereby said blower draws in outside ambient air.

10. Apparatus for feeding fibers to textile processing equipment such as a carding machine, said apparatus including:

(a) an axially extending opening roller;

(b) a substantially enclosed fiber collecting chute means extending generally downwardly beneath said opening roller to receive fibers therefrom, said chute means including a generally vertically extending wall having an upper portion formed with perforations and having a lower portion arranged for oscillating movement for densifying the fiber in said chute means during movement in one direction; and (c) a closed compartment adjacent said chute means and separated therefrom by at least a portion of said perforated wall portion and by said oscillating wall portion, whereby movement of said oscillating wall portion in the other direction thereof will cause air to be forced into said chute means through said perforated wall portion.

* * * * *